United States Patent [19]

Long et al.

[11] Patent Number: 4,889,269

[45] Date of Patent: Dec. 26, 1989

[54] WEB CENTER-GUIDING APPARATUS

[75] Inventors: Michael Long; Thomas W. Palone, both of Rochester; Paul Kemp, Churchville, all of N.Y.

[73] Assignee: Eastman Kodak Company, Rochester, N.Y.

[21] Appl. No.: 254,341

[22] Filed: Sep. 21, 1988

[51] Int. Cl.[4] ..... B65H 23/24

[52] U.S. Cl. ..... 226/97; 226/15; 226/196; 226/197

[58] Field of Search ..... 226/7, 15, 97, 196, 226/197; 384/12, 100; 242/76

[56] References Cited

U.S. PATENT DOCUMENTS

| | | | |
|---|---|---|---|
| 3,156,398 | 11/1964 | Lauxen et al. | 226/197 X |
| 3,971,496 | 7/1976 | Karsh | 226/15 X |
| 4,288,015 | 9/1981 | Curtin | 226/197 X |
| 4,336,900 | 6/1982 | Pontoni | 242/76 X |
| 4,474,320 | 10/1984 | Rueger | 226/7 X |

FOREIGN PATENT DOCUMENTS

| | | | |
|---|---|---|---|
| 726992 | 2/1966 | Canada | 226/7 |

*Primary Examiner*—Stanley N. Gilreath
*Assistant Examiner*—Phillip S. Han
*Attorney, Agent, or Firm*—Charles E. Snee, III

[57] ABSTRACT

An air-bearing center-guiding apparatus is disclosed for supporting and laterally center-guiding thin, flexible webs of paper or plastic under 15 mils in thickness. The apparatus comprises a web support and guide member 10 having an inner surface 58 and an outer web-facing surface 60. The web support and guide member 10 comprises a base member 14 for supporting an inner ring 22, an end cap 38, and a center ring 28 interposed therebetween. Parallel, circumferentially extending rows of circumferentially elongated and spaced-apart guide apertures 62 are provided in the web support and guide member 10 along edge regions of the web. The guide apertures 62 are formed between end surfaces 46 of the center ring 28 and interengaging end surfaces of the inner ring 22 and end cap rings 38. Each guide aperture 62 extends substantially perpendicular to the surface of the web and defines in cross-section an opening having a straight side and a curved side for directing jets of air against the web edges for developing a guiding force for holding lateral movement of the web to plus or minus 0.001 inch (.0254 mm). A row of support apertures 56, separate from the guide apertures 62, is provided in the center ring 28 between the rows of guide apertures 62 to form an air-bearing for the web.

14 Claims, 3 Drawing Sheets

FIG. 1
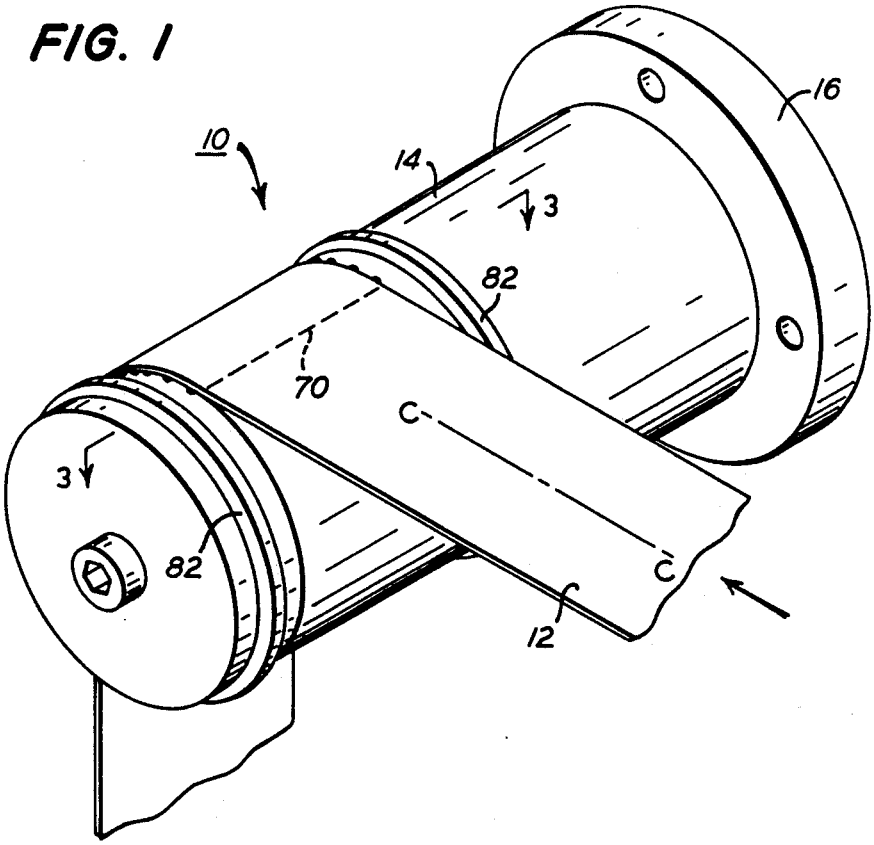
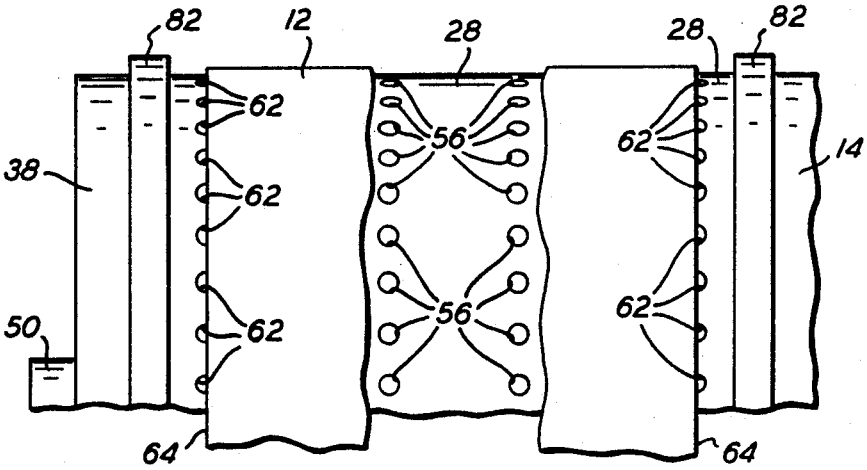
FIG. 2

FIG. 3
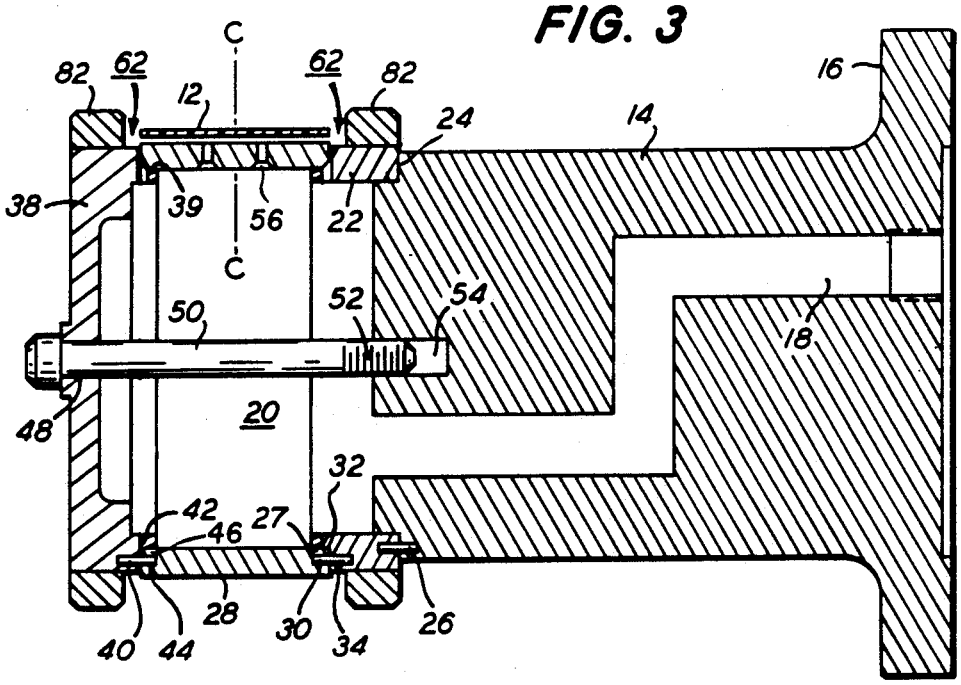
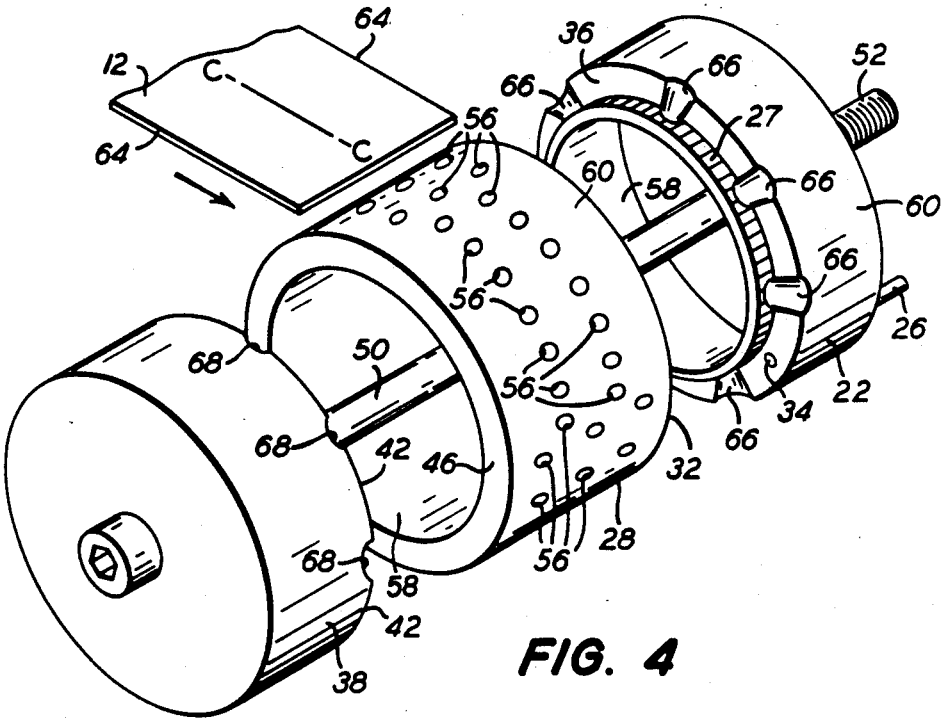
FIG. 4

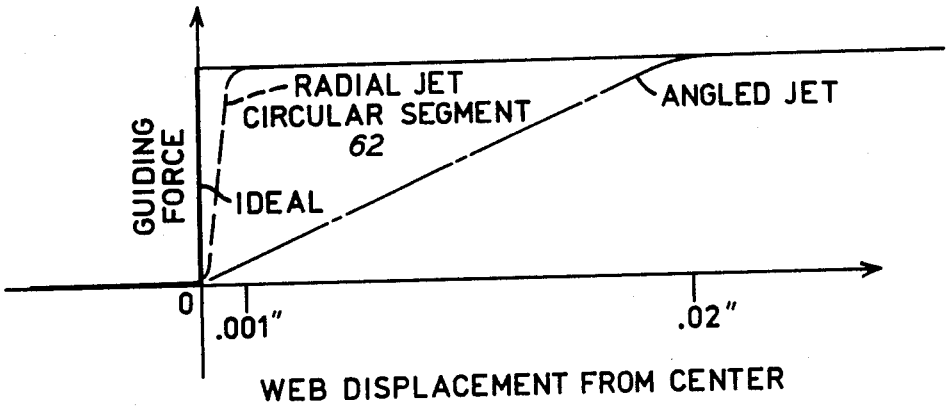
FIG. 6
FIG. 5
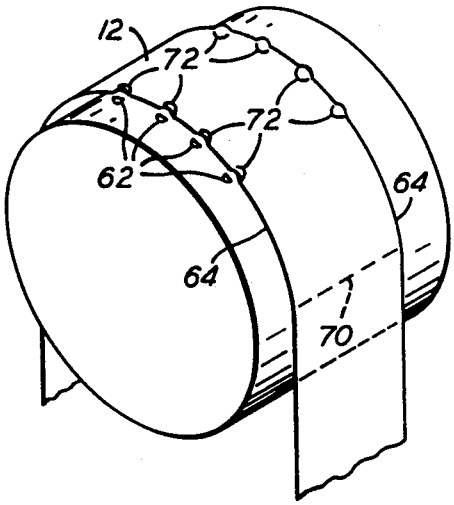
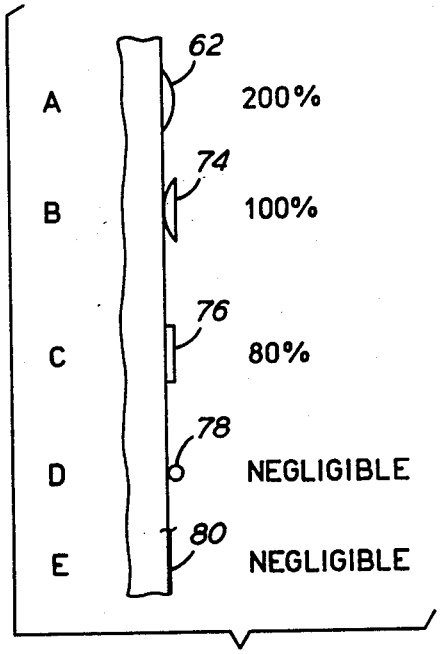
FIG. 7

WEB CENTER-GUIDING APPARATUS

CROSS-REFERENCE TO RELATED APPLICATION

This application relates to applicants' copending application Ser. No. 247,224, entitled AN AIR-BEARING CENTER-GUIDING APPARATUS, filed concurrently herewith.

FIELD OF THE INVENTION

The present invention relates generally to web-guiding apparatus, and more particularly to an air-bearing center-guiding apparatus for supporting and laterally center-guiding thin webs.

BACKGROUND OF THE INVENTION

Air-bearing center-guiding apparatus for supporting and laterally center-guiding webs are generally well-known in the art, of which the following U.S. Pat. Nos. 3,971,496, 4,197,972, 4,288,015 and 4,474,320 are exemplary. Although the apparatus described in these patents provide some lateral center-guiding of webs, the center-guiding force developed is negligible for small displacements when applied to guiding thin webs on the order of 15 mils or less in thickness.

Thus, the general object of the present invention is to provide an improved air-bearing center-guiding apparatus for supporting and guiding a thin web in a noncontacting manner. Particularly, the apparatus is made of three interengaging rings or cylinders to provide guide apertures arranged along the web edges of a specially designed shape whereby a web-guiding force is developed for guiding a web along a central axis providing a deviation tolerance of plus or minus 0.001 inch (0.0254 mm).

SUMMARY OF THE INVENTION

The objects of this invention are accomplished by providing an air-bearing center-guiding apparatus for supporting and laterally center-guiding a thin web along a longitudinally extending web center line wherein the web has longitudinally extending side edges defining a predetermined web width, comprising:

an inner member having an inner end surface;

an outer member in alignment with the inner member and having an outer end surface;

a center member in alignment with and interposed between the inner and outer members and of a width substantially equal to the web width, the center member having an outer web-facing surface, and opposite center end surfaces in mating engagement with the inner and outer end surfaces;

a plurality of spaced-apart guide apertures formed between the center end surface and mating inner and outer end surfaces and extending through the outer web-facing surface, each guide aperture extending substantially perpendicular to the surface of the web and defining in cross-section a flow passage shaped a segment of liked a circle having a straight side and a curved side;

web-support means interposed between the center end surfaces and extended through the outer web-facing surface; and a source of pressurized air coupled to the web-support means for directing air therethrough to form an air cushion adjacent the web, and coupled to the guide apertures for directing air therethrough to laterally center-guide the web.

In a more specific embodiment of the invention, each straight side of the guide apertures is substantially in register with an edge of the web, and each curved side thereof extends in a direction laterally outwardly of a longitudinally extending center line of the web.

In another embodiment of the invention, the width of each guide aperture is approximately 6 mils and the length of each straight side is approximately 30 mils.

In still another embodiment of the invention, the center member over which the web is guided comprises a fixed arcuate member having a leading section, an intermediate section and a trailing section. A pair of parallel rows of support apertures extend circumferentially along the intermediate section, the support apertures being arranged in spaced-apart relation in each row. Additional flotation means, such as at least three parallel rows of support apertures extend circumferentially along the leading and trailing sections, the support apertures being arranged in spaced-apart relation in each row.

In a further embodiment of the invention, the center-guiding apparatus comprises a base member having a cylindrical shoulder, an inner ring mounted on the cylindrical shoulder, a center ring having an annular end surface engageable with an annular end surface of the inner ring, an outer ring or end cap having an annular end surface engageable with the opposite annular end surface of the center ring, and means for securing the inner, center and outer rings to the base member. The guide apertures are formed between the annular end surfaces of the center ring and the mating annular end surfaces of the inner and outer rings. The curved sides of the circular segments of the guide aperture are formed in the annular end surface of the inner and outer rings, and the straight sides of the circular segments are formed by the annular end surfaces of the center ring.

BRIEF DESCRIPTION OF THE DRAWINGS

In the detailed description of the invention presented below, reference is made to the accompanying drawings, in which:

FIG. 1 is a perspective view of a preferred embodiment of an air-bearing center-guiding apparatus of this invention;

FIG. 2 is an enlarged segmental top plan view of the apparatus of FIG. 1 with portions thereof broken away;

FIG. 3 is an enlarged section view taken through the axis of the apparatus of FIG. 1 substantially along line 3—3;

FIG. 4 is an exploded perspective view of the apparatus of FIG. 1 with portions thereof omitted.;

FIG. 5 is a perspective view of an air-bearing center-guiding apparatus of this invention showing the web side-edge deformation in exaggerated form caused by air flow from the guide apertures;

FIG. 6 is a graph showing the guiding force developed by an ideal guide aperture, a radial jet circular-segment guide aperture, and an angled jet guide aperture relative to web displacement from the longitudinal center line of the web; and FIG. 7 is a graph showing the relative efficiencies of the various shapes of guide apertures for producing a guiding force of roughly 1 gram per aperture.

DETAILED DESCRIPTION OF A PREFERRED EMBODIMENT

Because web-guiding apparatus are well-known in the art, the present description will be directed in particular to elements forming part of, or cooperating directly with, a web-guiding apparatus in accordance with the present invention. It is to be understood that elements not specifically shown nor described may take various forms well-known to those skilled in the art.

With reference to FIGS. 1–4, a preferred embodiment of a noncontact apparatus or air bar 10 for supporting and laterally center-guiding a thin web 12 is disclosed. The apparatus comprises a cylindrical housing 14 having a radially extending flange 16 adapted to be rigidly secured to a fixed frame, not shown, by screws or the like. The housing 14 further has a passageway 18 through which air under pressure from any suitable air pressure source, not shown, is directed into a cavity 20 of the web-supporting and -guiding apparatus.

The apparatus, as best seen in FIGS. 3 and 4, comprises an inner ring or cylindrical shell 22 mounted on a shoulder 24 of the housing. Inner ring 22 has a pin 26 (FIG. 3) for pinning inner ring 22 to housing 14 in a predetermined angular orientation, and an axially and circumferentially extending flange 27 for supporting a center ring or cylindrical shell 28 in axial alignment therewith. Center ring 28 preferably has an outer diameter slightly larger than that of inner ring 22, for a purpose to be explained hereinafter. Center ring 28 further has a pin 30 extending axially outwardly from an end surface 32 thereof into complementary opening 34 in an end surface or shoulder 36 of inner ring 22 for securing the two in a predetermined angular orientation. The apparatus further has an outer ring in the form of a cylindrical end cap 38 having an outer diameter slightly smaller than that of center ring 28. The end cap 38 has an axially and circumferentially extending flange 39 for supporting center ring 28, and further has a pin 40 extending axially outwardly from an end surface or shoulder 42 of the end cap into a complementary opening 44 in an end surface 46 of center ring 28 for positioning the end cap in a predetermined angular orientation relative to the center ring. The end cap 38 has a center opening 48 through which a bolt 50 extends with a threaded end 52 thereof in threaded engagement with a threaded blind bore 54 in housing 14. Accordingly, when bolt 50 is tightened by an Allen wrench or the like, the inner ring 22, center ring 28 and end cap 38 are pressed together in axial alignment into engagement with housing 14.

The center ring 28 is provided with any suitable support means, such as a plurality of web-support apertures 56 radially extending from an inner surface 58 thereof to an outer web-facing surface 60 thereof, through which jets of air are directed from cavity 20 to support thin film or web 12 on an air cushion of substantially 10 mils thickness. Alternatively, sections of center ring 28 may be formed of porous material.

It has been noted that the web-supporting air jets emitted from support apertures 56 negatively influence the web-guiding function, causing a tendency toward lateral instability which is a function of the shape and amplitude of the pressure distribution profile. The amplitude of the pressure distribution profile is determined by the air pressure supplied to the support apertures 56. The shape of the pressure distribution profile is determined by the placement of the support apertures 56 and represents a compromise between lateral stability and pressure uniformity. It was found that a single row of support apertures at the web center line, designated c—c in FIG. 1 and FIG. 3, created a sinusoidal jet pressure profile producing a small decentering force gradient. Moreover, such centrally positioned support jets lacked the pressure uniformity required to support webs with nonuniform tension distribution and widthwise web curl. Accordingly, a pair of rows of pressure apertures 56 is used, as best seen in FIG. 4, to increase the pressure uniformity, though slightly increasing the decentering force gradient which is proportional to the distance of the apertures from the web center line c—c.

The support apertures 56 are sized to accommodate the pressures required by guide apertures 62, to be explained hereinafter, of 20–30 pounds per square inch gage (psig). The size, placement and number of support apertures 56 must meet the following conditions:

1. The shape and amplitude of the pressure distribution profile under web 12 must have a decentering tendency on the web much smaller than the centering force of guide apertures 62.

2. Air must exit the support apertures 56 at a sufficient rate and pressure and be distributed so as to support the web at a height sufficient to prevent camber, widthwise curl and nonuniform tension distributions from causing the web to contact the air bar under the applied web tension.

3. The pressure differential through the support apertures 56, and therefore the radial stiffness of the support air film or cushion, must be high enough to support web 12 despite dynamic tension transients.

These three conditions influence the design toward a large-diameter web-support guiding apparatus operating in the 20–30 psig range having numerous guide apertures 62 and numerous small-diameter support apertures 56 which are placed as close to the web center line c—c as permitted, given the web and tension nonuniformities of a particular application.

The web 12 is laterally center-guided without contact through jets of air issuing radially from the aforementioned guide apertures 62 arranged along side edges 64 of web 12; see FIG. 2. The guide apertures 62 comprise a plurality of angularly or circumferentially spaced, radially extending bores 66,68 along end surfaces 36,42 and through flanges 27,39 of inner ring 22 and end cap 38, respectively, which are partially closed off by the end surfaces 32,46 of center ring 28; see FIG. 3 and FIG. 4. Accordingly, the guide apertures 62 formed by the mating end surfaces 32,36 and 46,42 of the center ring 28 and the inner and outer rings 22,38 have in a cross-section a curved side formed by bores 66,68 and a straight side formed by the end surfaces 32,46 of the center ring. By providing the inner and outer rings 22,38, respectively, with an outer diameter smaller than that of the center ring, a space is provided at the upper end of the guide apertures through which a large quantity of ambient air can be entrained which greatly amplifies the guiding force of the small amount of air exiting the guide apertures 62. Accordingly, the radially extending guide apertures 62 of the aforementioned configuration create a very high centering force gradient which makes them capable of guiding thin webs to within plus or minus a few mils and sets them apart from web-guiding apparatus with angled guide jets, which typically have a low centering force gradient. The guide apertures of this invention have demonstrated a centering force gradient of 200 grams per millimeter with a peak centering force of 15 grams. The centering force is a function of the shape, size, spacing and number of guide apertures 62, the pressure supplied to those apertures, the web porosity and stiffness, and the pressure profile of the air supporting the web. This profile consists of two components: (1) a low-pressure region of the web created by high-velocity air from the guide apertures 62 rushing past the edge of the web and (2) a positive-pressure region under the web created by pressurized air from support apertures 56.

For webs 12 which exhibit strong widthwise curl (such as most photographic films) and where even light contact between the web-guiding apparatus and the side edges 64 of the web is unacceptable, it is strongly recommended that the apparatus support web 12 with the edges 64 thereof curling away from the apparatus. Accordingly, for photographic films at humidities below 60 percent relative humidity, the emulsion surface should face away from the apparatus. This recommendation is based on the observation that the humidity of compressed air is generally not controlled or controlled only to the extent that it is "dry". This dry air blowing directly on the emulsion can dry it appreciably in a matter of seconds, causing considerable curl. If the emulsion surface were facing the web-guiding apparatus, it would be difficult to prevent the edges 64 of the web from contacting the apparatus, particularly at the entering and exiting web tangency lines 70, only one of which is shown dotted in FIGS. 1 and 5 of the apparatus. The web tangency lines 70 extend widthwise of web 12 at right angles to the web edges 64 and are located where the web engages and departs from the outer periphery of center ring 28. If the emulsion surface faces away from the apparatus, drying effects are reduced and the system becomes relatively insensitive to web curl, making it practical to support and guide webs completely without contact.

As web tension is increased beyond normal operating levels, however, the first areas of web contact will be at the edges 64 of the web at the entering and exiting web tangency lines 70. For this reason, any suitable special aperture pattern is used in the area of these tangency lines, as seen in FIG. 4, to increase the volume or consumption rate of support air to counteract the extra air leakage at the tangency lines. The special aperture pattern, for example, comprises three axially spaced rows of two circumferentially spaced apertures 56, with one row in register with the center line c—c and the other rows interposed between the guide apertures 62 and the aforementioned innermost pair of rows of support apertures 56.

With reference to FIG. 5, it has been observed that a plurality of local uplifted deformations 72 of the web edges 64, each of substantially arcuate shape in radial and axial directions, accompanies a strong guiding force effect. These local deformations 72 are not observed with very stiff webs, for example, 15-mil Estar (trademark of the Eastman Kodak Company) or 3-mil steel webs, and the guide jets of air provide virtually no guiding effect with such stiff webs. These local deformation 72 are also not present when air at a pressure of substantially 20 psig and an equal air-consumption rate is directed through a continuous circumferential slit (FIG. 7E) to form a continuous narrow ring of air, or through small cylindrical guide apertures (FIG. 7D). The shape of guide aperture 62 has proven to be very important to the guiding force developed and the guiding force gradient.

A high guiding force gradient is required to guide a web to tight axial tolerances relative to the longitudinally extending center line c—c (FIG. 1) of the web. The web-guiding apparatus of this invention is designed to guide a thin web 12 to a plus or minus .001-inch tolerance. With reference to FIG. 6, it has been observed that a radial jet from circular-segment guide apertures 62 of this invention will guide a web to a plus or minus .001-inch tolerance, whereas angled jets produced by angled guide apertures typically have a guiding ability of approximately plus or minus .020-inch tolerance. In operation, it is observed that, when a web guided by the guide apertures 62 of this invention is manually displaced from the center line c—c and released, it very crisply snaps back to the centered position without extensive overshoot or oscillation. It is believed that this is due to the radial jets of air emitted from the circular-segment guide apertures 62 forming longitudinally spaced local deformations 72 of the web edges 64, as shown in FIG. 5.

With reference to FIG. 7, for an equal air-consumption rate generating approximately 1 gram per aperture guiding force, the following relative guiding force rations were observed for the differently shaped guide apertures shown therein. The numbers indicated therein are related to the relative efficiencies of the various shapes at producing the 1 gram-per-aperture guiding force. A was observed, the circular-segment apertures 62 of this invention, in which the straight sides thereof are substantially in register with the web edges (FIG. 7A), had an efficiency rating of 200 percent in developing the guiding force of roughly 1 gram per aperture. The next most efficient guide aperture shape is shown in FIG. 7B and involves a circular-segment aperture 74 identical to, but reversely oriented relative to, the circular-segment aperture 62 shown in FIG. 7A. This is achieved by providing curved sides on the end surfaces 32,46 of the center ring 28 and straight sides formed by flat end surfaces 36,42 of inner ring 22 and end cap 38, respectively. With this guide-aperture design, the curved sides of the guide apertures 62 are concave outwardly from the center line of the web; and the apexes of the curved sides of the guide apertures 62, which are opposed to the straight sides 74 (FIG. 7B), are arranged substantially in register with side edges 64 of the web. That is, as seen in FIG. 7, the edge of the web is substantially tangent to the projected apexes of the curved sides of the guide apertures, while the straight side 74 extends beyond the edge of the web. In FIG. 7C, radially extending rectangular-shaped guide apertures 76 had an air-efficiency rating of 80 percent, whereas radially extending, angled or perpendicular cylindrical guide apertures 78 and continuous slit-guide apertures 80, as shown in FIGS. 7D and E, respectively, had a negligible efficiency rating.

A plurality of the web-guiding apparatus or air bars may be used together to support and guide endless webs. In such applications, the inner and outer rings 22,38, respectively, may be provided with any suitable guide rings 82 (FIGS. 1–3) to allow an operator to readily train the web around the center rings 28 of the air bars. The guide rings 82 encircle the inner and outer rings and may be secured thereto by any suitable detents or clamp means, not shown.

The invention has been described in detail with particular reference to a preferred embodiment thereof, but it will be understood that variations and modifications can be effected within the spirit and scope of the invention.

What is claimed is:

1. An air-bearing center-guiding apparatus for supporting and laterally center-guiding a thin web along a longitudinally extending web center line, wherein the web has longitudinally extending side edges defining a predetermined web width, comprising:

an inner member having an inner end surface;

an outer member in alignment with the inner member and having an outer end surface;

a center member in alignment with and interposed between said inner and outer members and of a width substantially equal to said web width, said center member having a convex outer web-facing surface and opposite center end surfaces in mating engagement with said inner and outer surfaces;

a plurality of spaced-apart guide apertures formed at the interface between said center and surfaces and said inner and outer end surfaces and extended through said web-facing surface, said guide apertures being oriented substantially perpendicular to the web and arranged in a pair of parallel spaced-apart rows, each said guide aperture defining in cross-section an elongated aperture having a straight side and a curved side with one of said sides substantially in register with a side edge of said web and the other of said sides extended beyond said side edge, whereby each said elongated aperture is positioned substantially beyond said width of said web;

web-support means in said center member interposed between said rows of guide apertures and extended through said outer surface; and a source of pressurized air coupled to said web-support means for directing air therethrough to form an air cushion below the web and coupled to said elongated guide apertures for directing jets of air therethrough against the web edges for forming localized web-guiding deformations on the web edges for laterally center-guiding the web along the web center line.

2. An air-bearing center-guiding apparatus according to claim 1, wherein said straight sides of said guide apertures are in register with the side edges of the web.

3. An air-bearing center-guiding apparatus according to claim 1, wherein said curved sides of said guide apertures are curved convexly outwardly from the longitudinally extending center line of the web.

4. An air-bearing center-guiding apparatus according to claim 1, wherein said curved sides of said guide apertures are curved concavely outwardly from the longitudinally extending center line of the web, with the apexes of said curved sides thereof substantially in register with the web edges.

5. An air-bearing center-guiding apparatus according to claim 2, wherein the web to be supported and guided is a flexible web of paper or plastic of a thickness under substantially 15 mils.

6. An air-bearing center-guiding apparatus according to claim 1, wherein the width of each guide aperture is substantially 6 mils and the length of each straight side is substantially 30 mils.

7. An air-bearing center-guiding apparatus according to claim 1, wherein said web-support means comprises a plurality of support apertures located substantially along the longitudinally extending center line of the web.

8. An air-bearing center-guiding apparatus according to claim 1, wherein said center member over which the web is guided is a fixed arcuate member having a leading section, an intermediate section and a trailing section, and wherein said web-support means comprises a pair of parallel, longitudinally extending rows of support apertures provided in the intermediate section for generating a predetermined volume of support air, said support apertures being arranged in spaced-apart relation in each row, and at least three parallel, longitudinally extending rows of further support apertures provided in said leading and trailing sections for generating a volume of support air greater than the predetermined volume, said further support apertures being arranged in spaced-apart relation in each row.

9. An air-bearing center-guiding apparatus according to claim 8, wherein said rows of support apertures are located substantially along the intermediate section of the arcuate member.

10. An air-bearing center-guiding apparatus according to claim 1, wherein the apparatus further comprises a base member having a first cylindrical shoulder, wherein said inner member is mounted on the first cylindrical shoulder, wherein said inner member has a second cylindrical shoulder, wherein the outer member has a third cylindrical shoulder, wherein the center member is mounted between said second and third cylindrical shoulders, and wherein means are provided for securing the inner, center and outer members to said base member.

11. An air-bearing center-guiding apparatus according to claim 10, wherein said inner, center and outer members comprise rings and said curved sides of said guide apertures are formed in the inner and outer end surfaces of the inner and outer rings and the straight sides of the circular segments are formed by the end surfaces of the center ring.

12. An air-bearing center-guiding apparatus according to claim 11, wherein the web enters the apparatus at a leading tangency line, wraps around a portion of the center ring, and leaves the apparatus at a trailing tangency line, and wherein the web-support means comprises two circumferentially extending rows of support apertures interposed between said rows of guide apertures in the wrap-around portion of the center ring for generating a predetermined volume of support air, and wherein three further circumferentially extending rows of support apertures are interposed between said rows of guide apertures at said leading and trailing tangency lines of the web, for generating a volume of support air greater than said predetermined volume.

13. An air-bearing center-guiding apparatus according to one of claims 1–12, wherein said inner, outer and center members are substantially cylindrical and the diameter of said inner and outer members is less than that of said center member, whereby said guide apertures are recessed below said web-facing surface.

14. An air-bearing center-guiding apparatus according to one of claims 1–12, wherein said curved side is shaped as a segment of a circle.

* * * * *